US009359869B2

(12) United States Patent
Hallundbæk

(10) Patent No.: US 9,359,869 B2
(45) Date of Patent: Jun. 7, 2016

(54) STIMULATION METHOD

(71) Applicant: WELLTEC A/S, Allerød (DK)

(72) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 52 days.

(21) Appl. No.: 14/362,685

(22) PCT Filed: Dec. 20, 2012

(86) PCT No.: PCT/EP2012/076282

§ 371 (c)(1),
(2) Date: Jun. 4, 2014

(87) PCT Pub. No.: WO2013/092798

PCT Pub. Date: Jun. 27, 2013

(65) Prior Publication Data

US 2014/0290935 A1 Oct. 2, 2014

(30) Foreign Application Priority Data

Dec. 21, 2011 (EP) ..... 11195000

(51) Int. Cl.

| | |
|---|---|
| ***E21B 43/116*** | (2006.01) |
| ***E21B 43/00*** | (2006.01) |
| ***E21B 28/00*** | (2006.01) |
| ***E21B 43/25*** | (2006.01) |

(Continued)

(52) U.S. Cl.

CPC ..... *E21B 43/003* (2013.01); *E21B 28/00* (2013.01); *E21B 43/116* (2013.01); *E21B 43/25* (2013.01); *E21B 43/263* (2013.01); *E21B 43/28* (2013.01); *E21B 43/281* (2013.01); *E21B 43/114* (2013.01)

(58) Field of Classification Search

CPC . E21B 43/117; E21B 43/1185; E21B 43/116; E21B 43/119; E21B 43/11852; E21B 43/1195; E21B 43/26; E21B 29/02; E21B 47/122; E21B 43/263

See application file for complete search history.

(56) References Cited

U.S. PATENT DOCUMENTS 2,915,122 A 12/1959 Hulse
4,049,053 A 9/1977 Fisher et al.

(Continued)

FOREIGN PATENT DOCUMENTS

WO WO 2011/146827 11/2011

OTHER PUBLICATIONS

International Preliminary Report on Patentability mailed Jul. 3, 2014 in International Application No. PCT/EP2012/076282 (7 pages).

(Continued)

*Primary Examiner* — Zakiya W Bates
(74) *Attorney, Agent, or Firm* — Nixon & Vanderhye P.C.

(57) ABSTRACT

A stimulation method involves arranging a fluid-activated gun in a well through a well head and/or a blowout preventer, dividing the well into a first and a second part, the first part being closer to the well head and/or blowout preventer than the second part, pressurizing the first part of the well with a hot fluid, the hot fluid having a temperature which is higher than the temperature of the formation at a downhole point of injection, activating the fluid-activated gun, thereby converting energy from the pressurized hot fluid into mechanical waves, directing said mechanical waves into the formation, and injecting the hot fluid into the formation simultaneous to activation of the fluid-activated gun via the hot fluid.

20 Claims, 7 Drawing Sheets

(51) Int. Cl.

| | |
|---|---|
| ***E21B 43/263*** | (2006.01) |
| ***E21B 43/28*** | (2006.01) |
| *E21B 43/114* | (2006.01) |

(56) References Cited

U.S. PATENT DOCUMENTS

| | | | | |
|---|---|---|---|---|
| 2003/0042018 | A1 | 3/2003 | Huh et al. | |
| 2006/0272821 | A1 | 12/2006 | Webb et al. | |
| 2009/0151938 | A1 | 6/2009 | Conkle et al. | |
| 2010/0252324 | A1* | 10/2010 | Woskov | E21B 7/14 175/11 |
| 2012/0055685 | A1 | 3/2012 | Sanders et al. | |
| 2012/0318499 | A1 | 12/2012 | Sanders et al. | |

OTHER PUBLICATIONS

International Search Report for PCT/EP2012/076282 mailed Mar. 4, 2013.

Written Opinion of the ISA for PCT/EP2012/076282 mailed Mar. 4, 2013.

* cited by examiner

STIMULATION METHOD

This application is the U.S. national phase of International Application No. PCT/EP2012/076282 filed 20 Dec. 2012 which designated the U.S. and claims priority to EP Patent Application No. 11195000.2 filed 21 Dec. 2011, the entire contents of each of which are hereby incorporated by reference.

FIELD OF THE INVENTION

The present invention relates to a stimulation method. Furthermore, the present invention relates to a stimulation system for stimulating oil production in an oil field.

BACKGROUND ART

In the recovery of hydrocarbon-containing fluid, such as oil, from hydrocarbon-bearing reservoirs, it is usually possible to recover only minor portions of the original oil by so-called primary recovery methods which utilise only the natural forces present in the reservoir. A variety of supplemental recovery techniques have been employed in order to increase the recovery of oil from subterranean reservoirs. The most widely used supplemental recovery technique is waterflooding which involves the injection of water into the reservoir. As the water moves through the reservoir, it acts to displace or flush the oil therein towards a production well through which the oil is recovered. During recovery of hydrocarbon-containing fluid, reservoir pressure is thus maintained by injecting water from injection wells surrounding the production wells. The water cut of the recovered hydrocarbon-containing fluid is measured on a regular basis to detect water breakthrough. The water may come from the injection well or may be water which is naturally occurring from the reservoir. In order to avoid water breakthrough and enhance production, it has been attempted to use so-called second recovery methods using other drive fluids, such as $CO_2$.

Another way of enhancing production of hydrocarbons in the recovered fluid is to use stimulation of the reservoir. The stimulation process comprises the use of tools and is rarely initiated before it is absolutely necessary, e.g. when the water cut is above a predetermined level, e.g. 90% water. Known stimulation tools send out mechanical vibrations into the reservoir when the water cut is decreasing or is above a predetermined level. The tool for emitting the vibrations is then submerged into the production well to the point approximately opposite the production zone while the production is set on hold. The production is then resumed after stimulation has been completed. Stimulation tools may also be arranged in the injection well so that production can continue during the stimulation process.

SUMMARY OF THE INVENTION

It is an object of the present invention to wholly or partly overcome the above disadvantages and drawbacks of the prior art. More specifically, it is an object to provide an improved stimulation method increasing the mobility of the oil-containing fluid in the reservoir.

The above objects, together with numerous other objects, advantages, and features, which will become evident from the below description, are accomplished by a solution in accordance with the present invention by a stimulation method comprising the steps of:

arranging a fluid-activated gun in a well, through a well head and/or a blowout preventer, dividing the well into a first and a second part, the first part being closer to the well head and/or blowout preventer than the second part, pressurising the first part of the well with a hot fluid, the hot fluid having a temperature which is higher than that of the formation at a downhole point of injection, activating the fluid-activated gun, thereby converting energy from the pressurised hot fluid into mechanical waves, directing said mechanical waves into the formation, and injecting the hot fluid into the formation simultaneous to activation of the fluid-activated gun by means of the hot fluid.

By activating the oil field continuously with hot fluid, the mobility of the oil-containing fluid is thus substantially increased. The mobility is increased both by the vibrations and the density change for the oil-containing fluid to accumulate in larger areas or pools in the formation, such as sandstone or limestone.

In an embodiment, the fluid may enter the gun in the first part, activating the gun, and exit the gun through an outlet to the second part and be injected into the formation.

The temperature of the hot fluid may be at least 10° C. higher than the temperature of the formation, preferably at least 25° C. higher than the temperature of the formation, and more preferably at least 50° C. higher than the temperature of the formation.

Also, the temperature of the hot fluid at the point of injection may be at least 150° C., preferably at least 175° C., and more preferably at least 200° C.

Moreover, the fluid-activated gun may discharge an energy of at least 50 grams TNT (trinitrotoluene) equivalence per activation, preferably at least 75 grams TNT equivalence per activation, and more preferably at least 100 grams TNT equivalence per activation.

The fluid-activated gun may be a gas-activated gun or a chemical reaction gun.

In one embodiment, the fluid-activated gun may be activated, resulting in a mechanical wave having a frequency between 0.01 and 40 Hz.

In another embodiment, the fluid-activated gun may be activated with a frequency between 0.01 and 40 Hz.

The fluid may be gas, such as methane gas or carbon dioxide.

The stimulation method as described above may further comprise the step of arranging the gun between two neighbouring valves having different inlet flow settings for transmission of mechanical waves into a region of the formation having a high pressure gradient, thereby releasing oil in said region.

By providing a pressure difference or pressure gradient while providing mechanical waves in that region, micro bores are created in the formation such as sandstone or limestone. Furthermore, the energy discharge provides micro bores in the formation in areas where a pressure gradient is present and thus helps the oil-containing fluid trapped in bore to flow and accumulate into larger areas of oil-containing fluid.

Further, the fluid-activated gun may be arranged in a heel position of the well.

Additionally, the stimulation method as described above may further comprise the step of anchoring the fluid-activated gun with at least one anchor in a borehole casing between the first part and the second part of the well before activation.

Moreover, the stimulation method as described above may comprise the step of inflating a packer surrounding the fluid-activated gun, thereby dividing the well between the first part and the second part before activation of the gun.

The gun may emit electromagnetic pulses of electromagnetic radiation.

The gun may comprise an electromagnetic hammer.

Also, the fluid-activated gun may be activated continuously while the first part of the well is pressurised.

In addition, the method as described above may be performed in sandstone and/or limestone.

The present invention also relates to a stimulation system for stimulation of oil production in an oil field, comprising:

a production well having a casing, an injection well having a casing, and a fluid-activated gun being arranged in the injection well, thereby dividing the injection well in a first and a second part, wherein the first part of the injection well is pressurised with hot fluid to activate the gun to provide mechanical waves into a formation surrounding the casing of the injection well, the hot fluid having a temperature which is higher than the temperature of the formation at a downhole point of injection.

In one embodiment, the temperature of the hot fluid at the point of injection may be at least 10° C. higher than the temperature of the formation, preferably at least 25° C. higher than the temperature of the formation, and more preferably at least 50° C. higher than the temperature of the formation.

In another embodiment, the temperature of the hot fluid at the point of injection may be at least 150° C., preferably at least 175° C., and more preferably at least 200° C.

Furthermore, the gun may be arranged permanently in the injection well.

In addition, the gun may comprise a gun body and a packer surrounding the gun body.

Also, the gun may be permanently anchored in the casing of the injection well.

Moreover, the injection well may comprise injection openings, and the openings may be arranged in the second part of the casing.

By having a fluid-activated gun which allows fluid through the gun after activation, the fluid may enter the second part of the well in order to be used for injection below the gun in the second part of the well.

Additionally, the well may comprise a heel, and the fluid-activated gun may be arranged close to the heel.

The stimulation system as described above may further comprise a pump arranged above the well at the well head or the blowout preventer or a rig.

In one embodiment, the fluid may be gas.

The gun may comprise a piston in a piston chamber and a spring arranged to be compressed when the pressurised fluid forces the piston in one direction in the chamber, said piston being subsequently released, producing the mechanical force by means of mechanical waves.

In one embodiment, the fluid may be a liquid.

In another embodiment, the fluid may be water.

Said gun may further comprise a pump for pressurising the well with fluid.

Also, the gun may have an inlet arranged in fluid communication with the first part of the well, and an outlet arranged in fluid communication with the second part of the well.

Furthermore, the gun may convert energy from the pressurised fluid into vibrations while injecting the gas into the formation.

The vibrations generated by the gun may propagate radially away from the well into the formation strata.

Moreover, the gun may comprise an outlet for letting the fluid enter into the second part of the well after activation of the gun in order for the fluid to be injected into the formation through the opening in the casing wall in the second part of the well.

In an embodiment, the fluid-activated gun may be a low frequency gun operating at frequencies between 0.01 and 40 Hz.

In addition, the fluid-activated gun may operate continuously while the first part of the well is pressurised.

Further, the system may comprise a plurality of production wells/injection wells, and a plurality of said wells may have a fluid-activated gun arranged therein.

Also, the stimulation system as described above may comprise annular barriers at four locations, creating a first production zone between a first annular barrier and a second annular barrier and a second production zone between a third annular barrier and a fourth annular barrier.

Furthermore, the casing may comprise a first valve section arranged in the first part of the well and a second valve section arranged in the second part of the well, the valve sections having different flow settings so that a pressure gradient is created in the formation between the first valve section and the second valve section.

In another aspect of the present invention, the stimulation system as described above may further comprise a plurality of inlet valves comprising at least two neighbouring valves having different inlet flow settings, wherein the activation means may be arranged between said two neighbouring valves having different inlet flow settings for transmission of mechanical waves into a region of the formation having a high pressure gradient, thereby releasing oil in said region.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
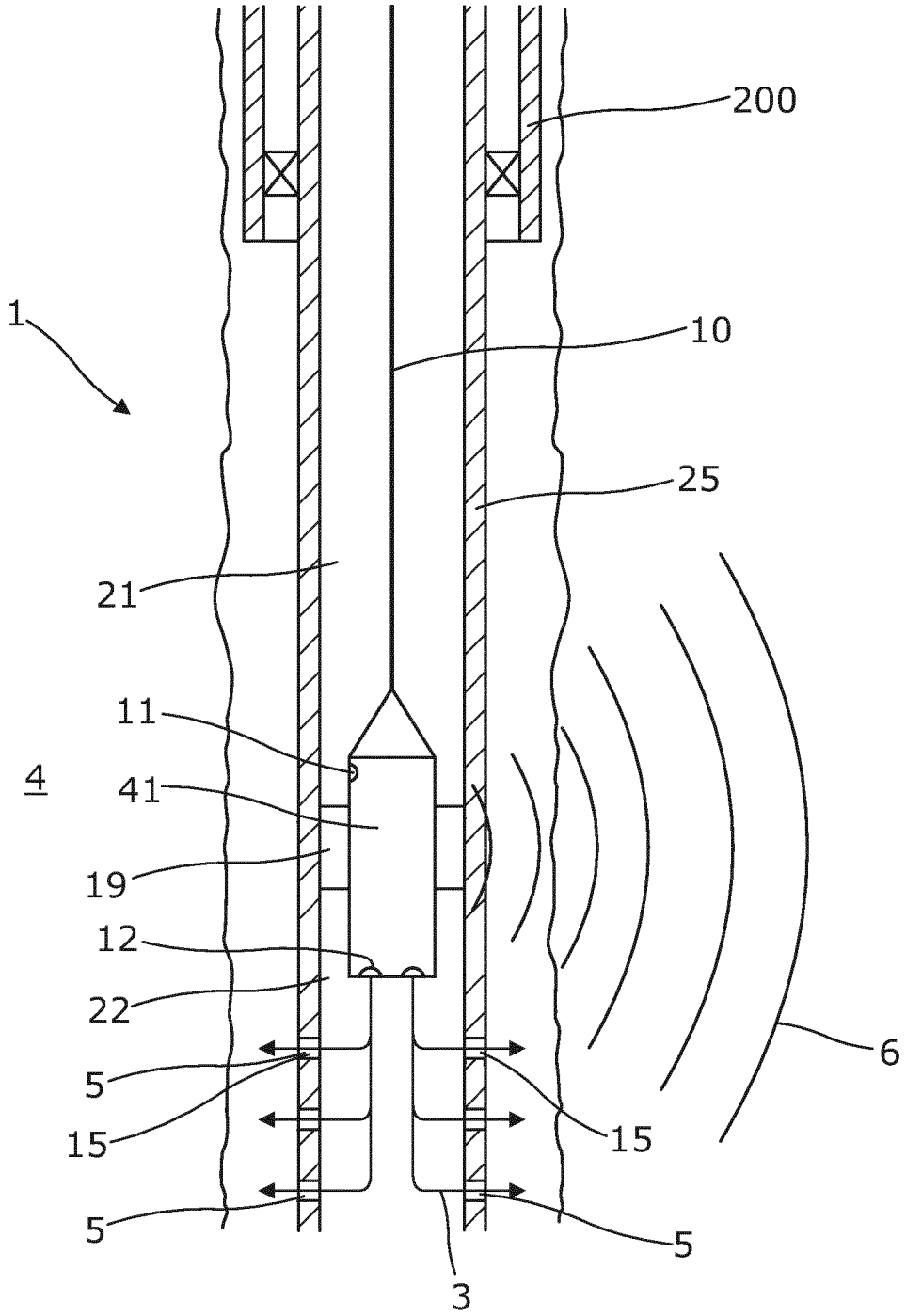
FIG. 1 shows a fluid-activated gun in a well.
Figure 6:
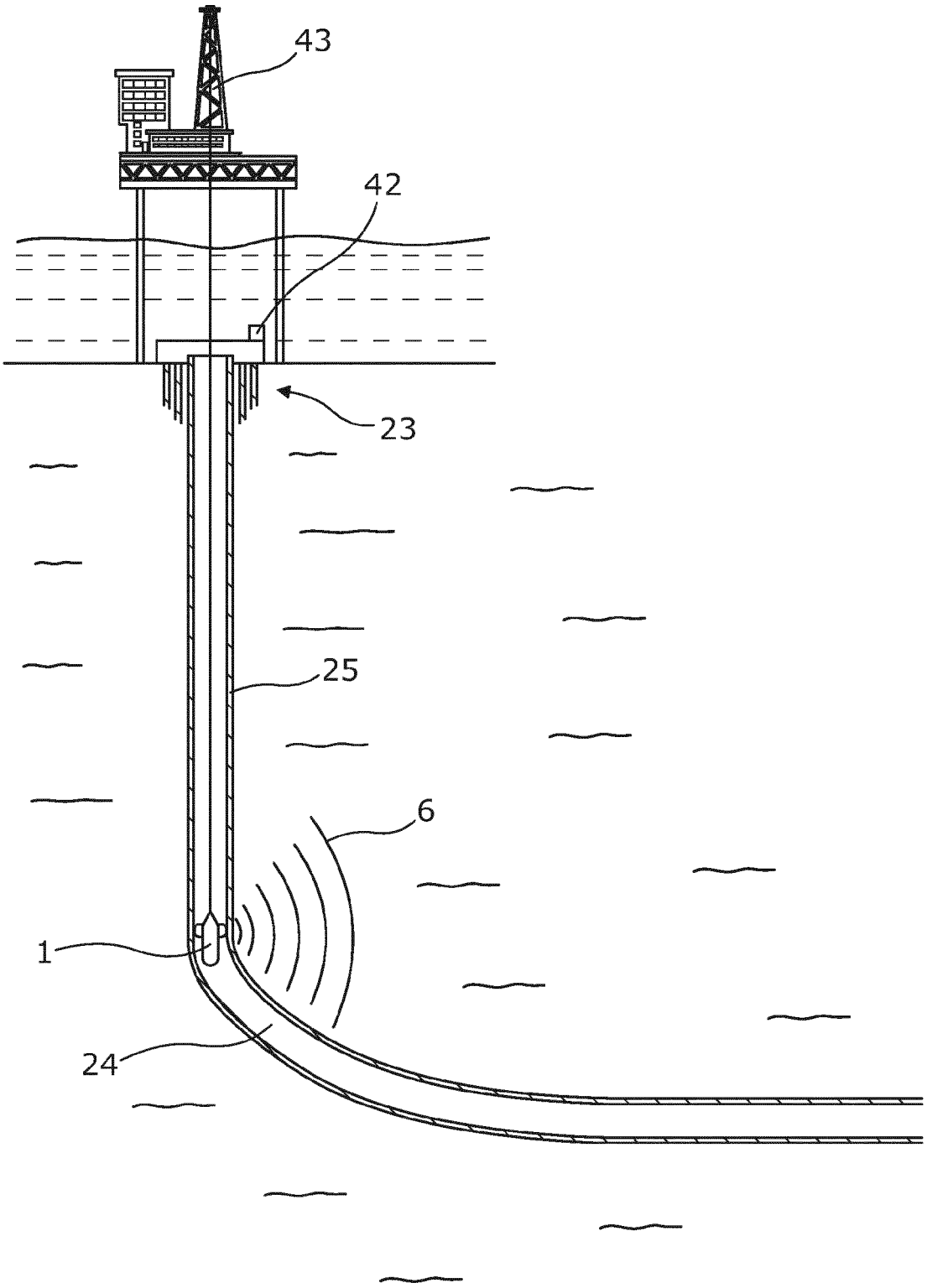
FIG. 6 shows the gun arranged near the heel portion of the well.

FIG. 1 shows a fluid-activated gun 1 in an injection well 200 dividing the well 2 into a first 21 and a second part 22 by means of an annular packer 19 anchoring and packing the gun in the casing 25. The first part 21 is the part of the well which is closest to a well head 23 and/or a blowout preventer 23 in the top of the well as compared to the second part 22, as shown in FIG. 6. The fluid-activated gun 1 of FIG. 1 is submerged into the well by means of a wireline 10 powering the gun and through which the gun may be controlled, e.g. for inflating the packer 19. After anchoring the gun in the well by the packer surrounding a gun body 41 of the gun, the first part 21 of the well 200 is pressurised with a hot fluid 3. The hot fluid has a temperature which is higher than the temperature of the formation 4 at a downhole point of injection 15 through openings 5 in the second part of the well. Having passed the gun, the fluid is injected through openings 5 in the casing 25 and the hot fluid heats up the fluid in the formation, resulting in a higher mobility of the oil-containing fluid in the reservoir. The injected fluid further displaces or drives the oil-containing fluid towards a production well, and the injected fluid also maintains reservoir pressure while oil is recovered.

The pressurised fluid in the first well part 21 activates the fluid-activated gun 1, thereby converting energy from the pressurised fluid 3 into mechanical waves 6 directed to travel through the formation and stimulate the mobility of the oil-containing fluid to flow more easily in the formation and accumulate in larger areas or pools in the formation which is sandstone or limestone. By injecting hot fluid 3 into the formation 4 simultaneous to activation of the fluid-activated gun 1, the mobility of the oil is increased even further as the oil, due to the heat, will flow more easily.

In FIG. 1, the fluid enters an inlet 11 of the gun in the first part of the well, activating the gun, and exits the gun through an outlet 12 to the second part and is injected into the formation. Part of the energy from the hot, pressurised injection fluid is converted into mechanical waves in the gun, and subsequently the injection fluid leaves the outlet and is injected into the reservoir through the openings 5 in the casing 25.

At the point of injection 15 through the openings 5, the temperature of the hot fluid is at least 10° C. higher than the temperature of the formation, preferably at least 25° C. higher than the temperature of the formation, and more preferably at least 50° C. higher than the temperature of the formation. The temperature of the hot fluid at the point of injection is then at least 150° C., preferably at least 175° C., and more preferably at least 200° C.

When providing mechanical waves, the fluid-activated gun 1 discharges an energy of at least 50 gram TNT equivalence per activation, preferably at least 75 gram TNT equivalence per activation, and more preferably at least 100 gram TNT equivalence per activation. As the activation then occurs substantially continuously and simultaneous to the injection, the total amount of energy over a period of 1 day discharged from the fluid-activated gun is equal to a perforation gun discharging an energy of at least 5 kilograms TNT equivalence per activation.

By the fluid-activated guns being activated substantially continuously, the production is optimised, meaning that the water cut is kept at an optimal level. By having such continuous activation, it is possible to bring up more oil-containing fluid from the oil field than by means of conventional methods and to increase the percentage of reservoir oil which the oil-producing company is able bring up from a reservoir. Presently, when oil is recovered, only a maximum of 40% is brought up. The rest is left in the reservoir, and when bringing up the 40%, the reservoir is disturbed to a degree that it is impossible to bring up the remaining 60%. Therefore, there has been a long-felt need to increase this percentage.

In FIG. 1, the fluid-activated gun 1 is a gas-activated gun, and thus the injection fluid 3 is gas, such as methane gas or carbon dioxide. In one embodiment, the gas accumulates in a piston chamber in the gun driving a piston in one direction in the chamber compressing a spring, and when the spring cannot be compressed any further, a release mechanism is activated and the piston moves at a high velocity in the opposite direction, hammering into the back wall of the chamber and creating the mechanical waves. In another embodiment, the gas gun is activated by pulsed injection fluid 3, creating the hammering effect to generate the mechanical waves.

Figure 2:
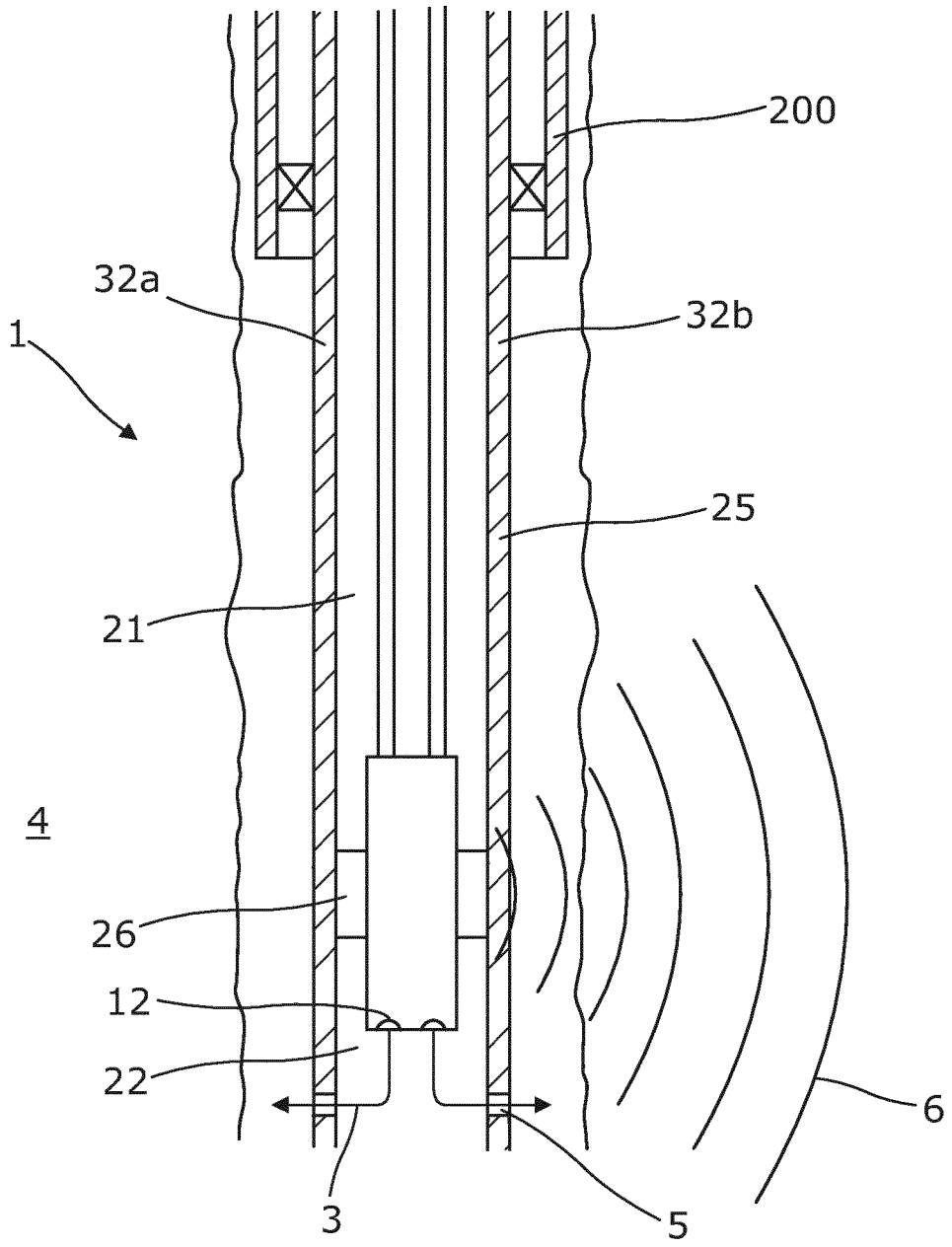
FIG. 2 shows another embodiment of a fluid-activated gun in a well.

In FIG. 2, the fluid-activated gun 1 is a chemical reaction gun supplied with two different fluids through each their tubing 32*a*, 32*b*, and the fluids are then mixed in the gun and react to generate the mechanical waves travelling through the formation to stimulate the oil production. The gun is anchored up in the well by means of anchors 26 and the injection fluid 3 enters through outlets 12 and through the openings 5 into the formation 4 but may also pass the anchors before being injected through the openings 5 in the casing 25 if the outlets are positioned above the anchors.

Figure 3:
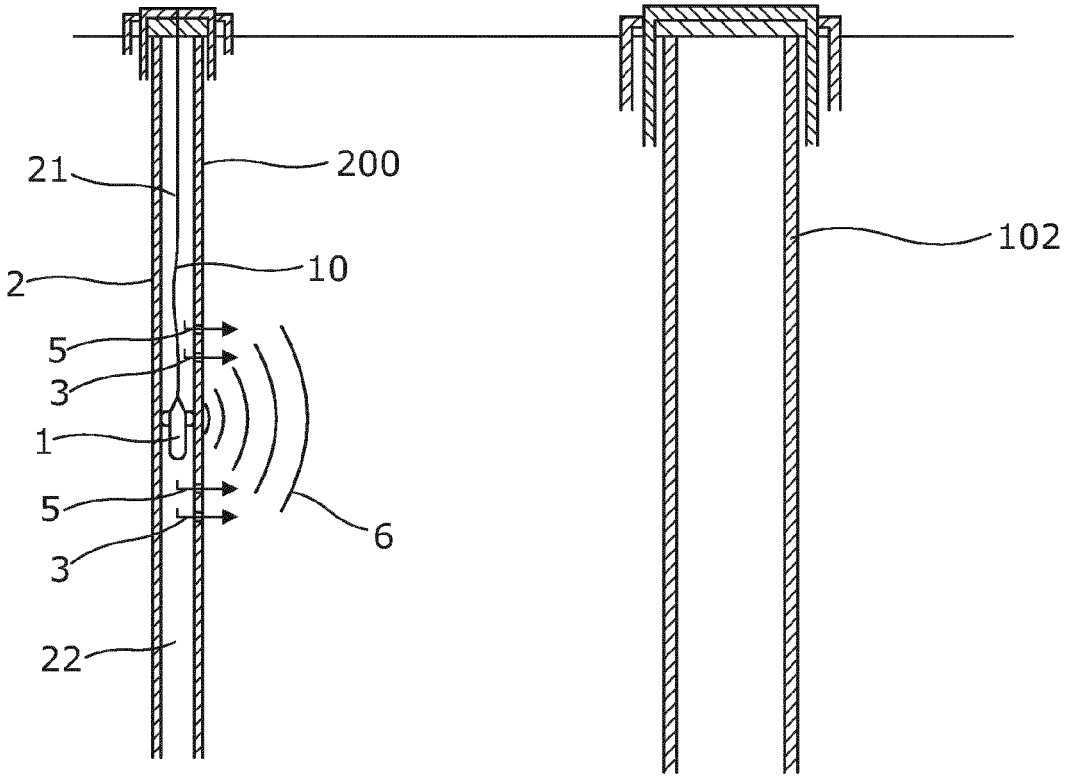
FIG. 3 shows both an injection well and a production well.

The fluid-activated gun 1 is thus typically arranged in an injection well 200 neighbouring a production well 102 as shown in FIG. 3 in order to stimulate the oil production by increasing the mobility of the oil in the reservoir. Some of the pressurised fluid 3 may be injected through openings 5 in the first part 21 of the well, and some may be injected through openings 5 in the second part 22 of the well after entering through the gun while the gun produces mechanical waves 6.

Figure 4A:
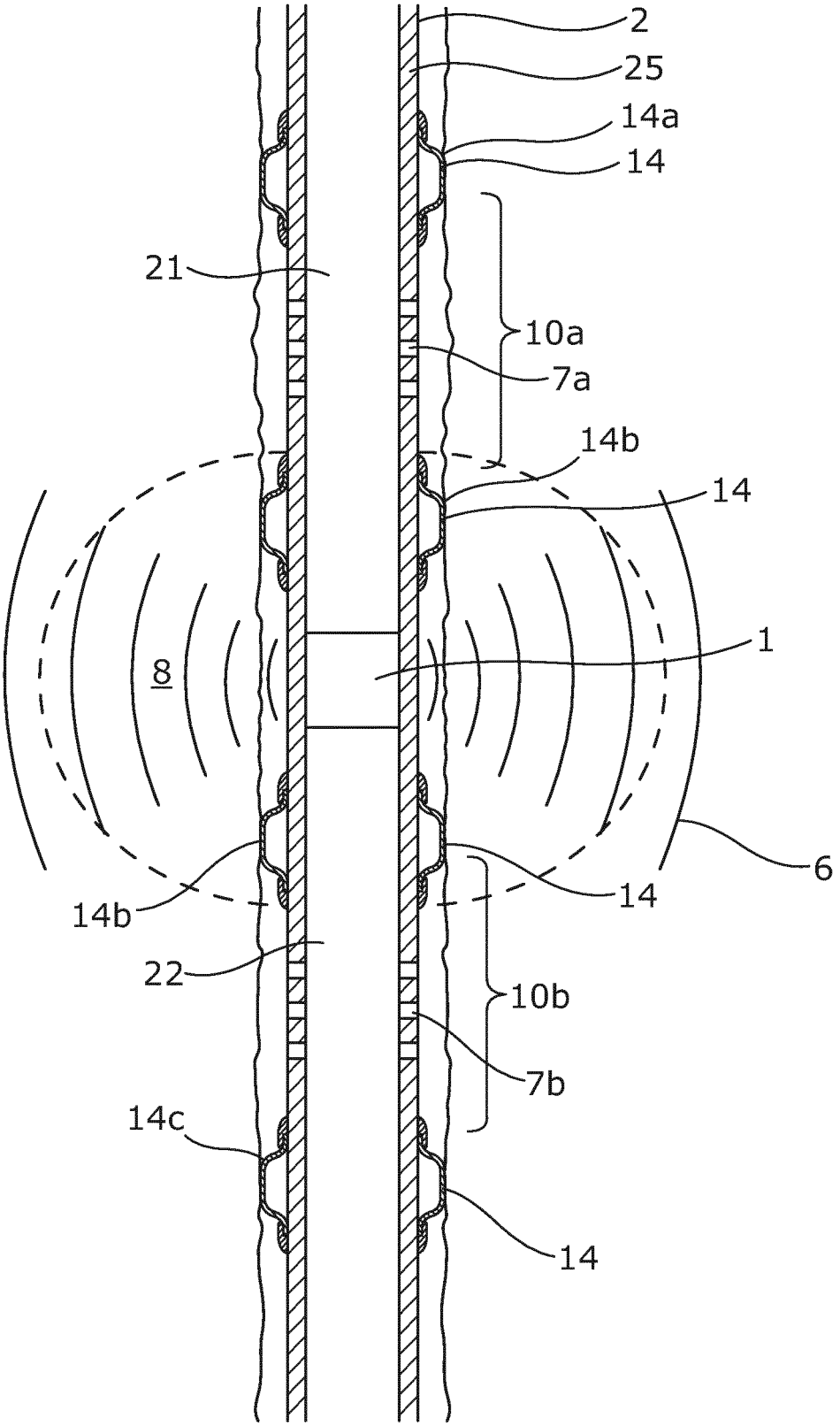
FIGS. 4*a* and 4*b* show a well having two production zones and a gun arranged therebetween.

In FIG. 4*a*, the gun 1 is arranged in a production well 2 between two neighbouring valve sections 7*a*, 7*b* having different inlet flow settings. The first valve section 7*a* is arranged in the first part 21 of the well and the second valve section 7*b* is arranged in the second part 22 of the well. By arranging annular barriers 14 at four locations, a first production zone 10*a* is created between a first annular barrier 14*a* and a second annular barrier 14*b*, and a second production zone 10*b* is created between a third annular barrier 14*c* and a fourth annular barrier 14*d*. The two production zones each has an inlet section 7*a*, 7*b* in which the first valve section 7*a* has a different flow setting than the second valve section 7*b*, thus creating the pressure difference in a region 8 between the two production zones 10*a*, 10*b*. The region is indicated by a dotted line. The gun then transmits mechanical waves 6 into the region 8 of the formation having a high pressure gradient, thereby releasing oil in said region due to the fact that the mechanical waves transmitted in that region create micro bores in the formation, particularly in sandstone or limestone formations.

Figure 4B:
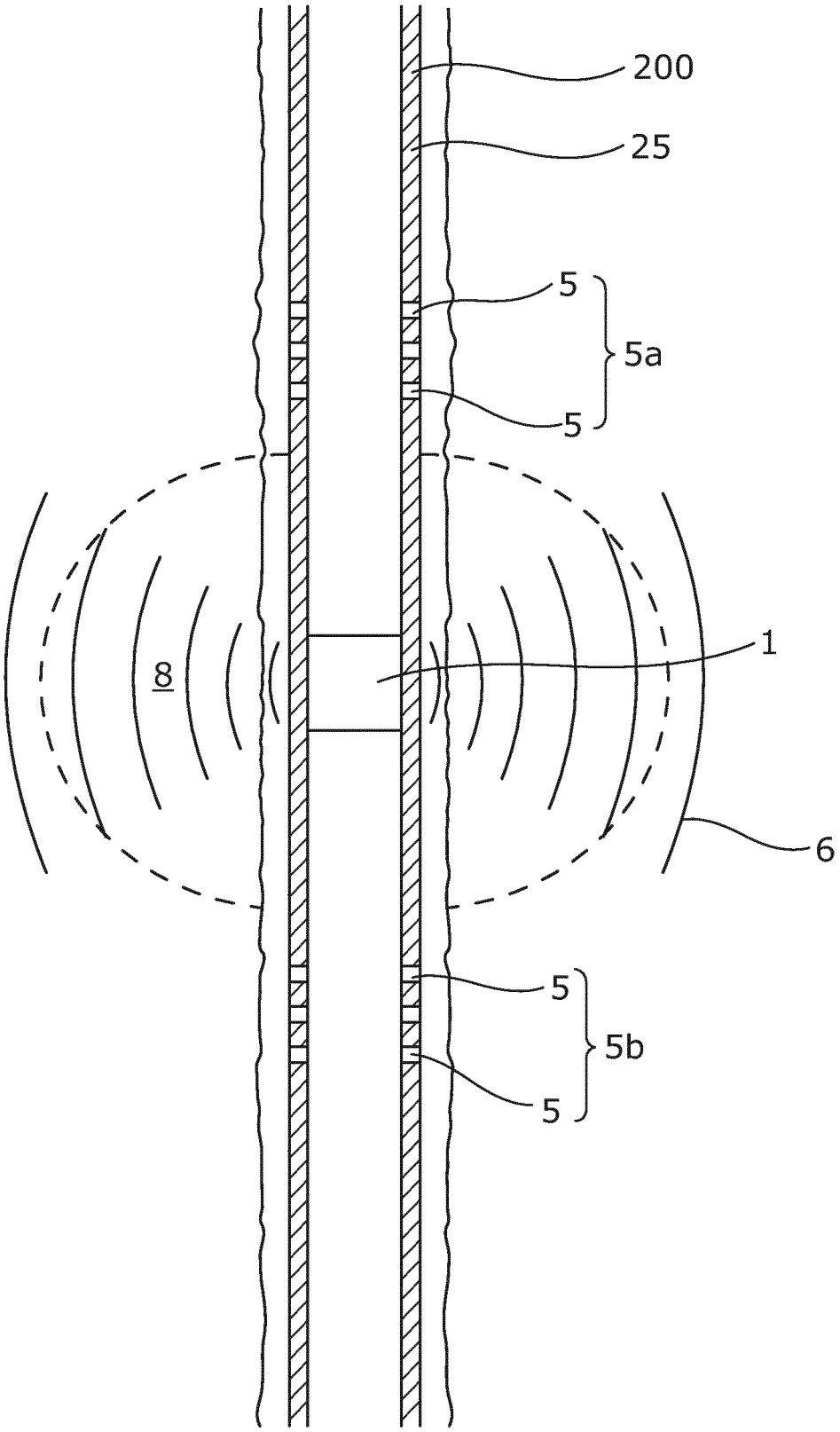

In FIG. 4*b*, the gun 1 is arranged in an injection well 200 between two injection or outlet sections 5*a*, 5*b* having different outlet flow settings at the openings 5 in the casing 25. The first outlet section 5*a* has a different flow setting than the second outlet section 5*b*, which creates the pressure difference in the region 8 between the two injection sections 5*a*, 5*b*. When the gun transmits mechanical waves 6 into the region 8 having the high pressure gradient, micro bores in the formation, particularly in sandstone or limestone formations, are created and thus oil trapped therein is released.

Water injection typically leads to an increase in the amount of oil which may be extracted from a reservoir. However, at some point water injection will not be able to force any more oil out of the reservoir, leading to an increase in the water cut. The increase in the water cut may originate from the water injection or from water presence close to the reservoir. At this point or even before, mechanical waves, through such part of the formation, may energize the formation, so that oil droplets or particles in the formation may gain enough energy to escape surfaces binding the oil droplets or particles in the formation, thereby allowing them to be dissolved in the free-flowing fluids in the formation, e.g. injection fluid. This may further increase the oil production in the reservoir, leading to a decrease in the water cut of the oil-containing fluid in the production wells. When the fluid in the formation has a pressure gradient, the formation may be forced to crack, fracture or splinter when subjected to the mechanical waves, allowing oil droplets or particles to escape closed oil pools, closed micro bores in the formation or other closed volumes in the formation, thereby increasing the level of oil in the oil-containing fluid. The gun may be moved further down the well to be positioned near the position in which the water is entering the well in order to provide this formation zone with sufficient power in the form of mechanical waves for the water to pool underneath the oil-containing parts of the formation.

Figure 5A:
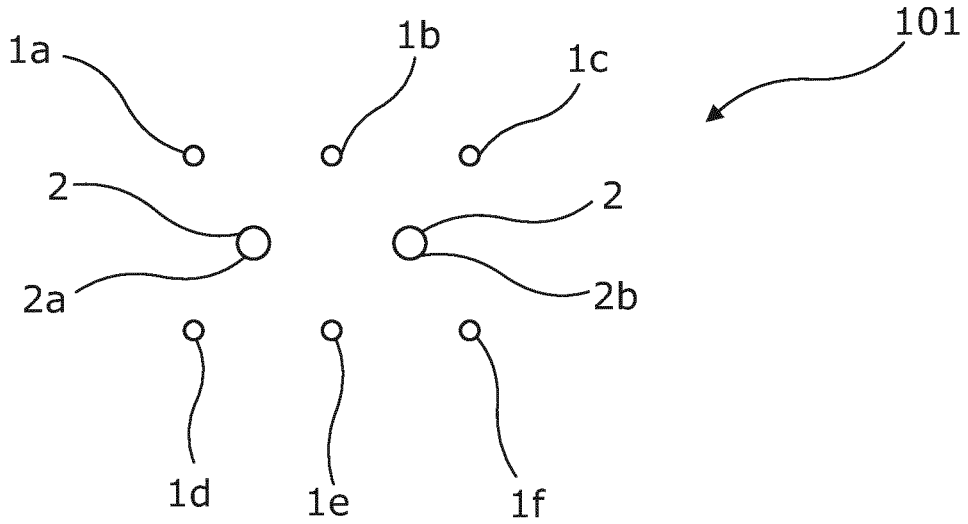
FIG. 5*a* shows an oil field seen from above.
Figure 5B:
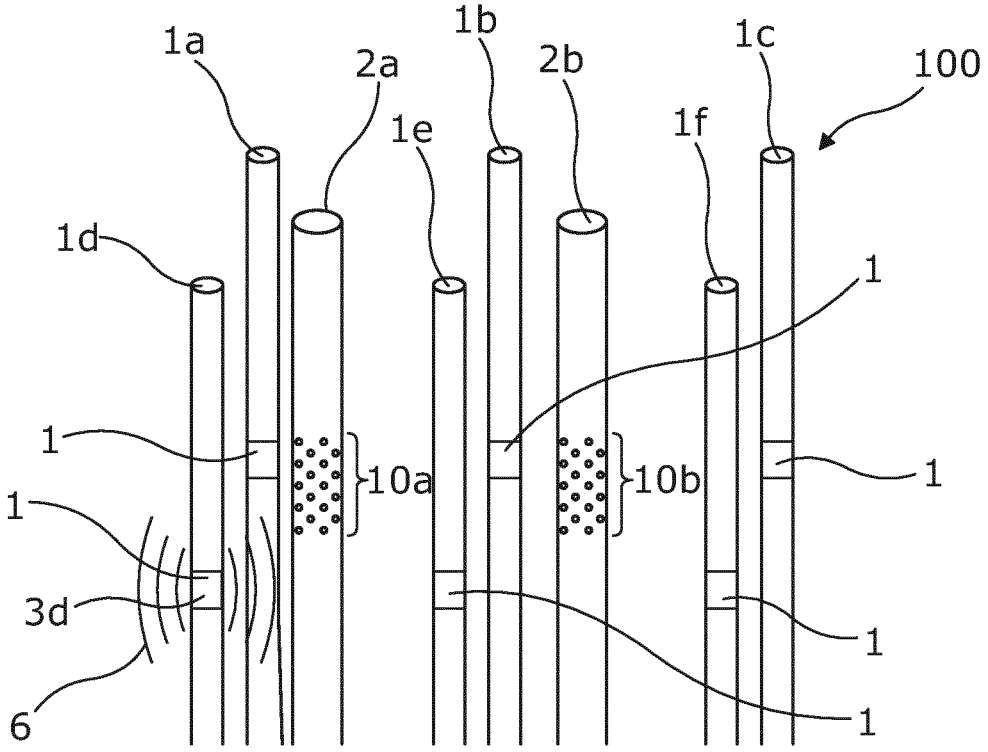
FIG. 5*b* shows a stimulation system seen in perspective illustration.

FIG. 5*a* shows an illustration of an oil field 101 seen from above comprising two production wells 2, 2*a*, 2*b* and six injection wells 1*a*, 1*b*, 1*c*, 1*d*, 1*e*, 1*f*. FIG. 5*b* shows a stimulation system 100 for stimulating oil production in the oil field 101. The stimulation system 100 comprises a plurality of injection wells 1*a*, 1*b*, 1*c*, 1*d*, 1*e*, 1*f*, a plurality of production wells 2*a*, 2*b* and a plurality of fluid-activated guns 1 arranged in the injection wells. In order to stimulate the oil production, the fluid-activated guns 1 are activated substantially continuously, forcing the oil-containing fluid towards the production zones 10*a*, 10*b* having openings.

By stimulating the oil field at a predetermined frequency, the production is stimulated on a regular basis and not just when the water cut is increasing. The pools of oil, i.e. subsurface oil accumulations such as volumes of rock filled with small oil-filled pores or micro bores, are then affected continuously by the discharged energies, and the production of oil from the formation is enhanced. The micro bores created by the stimulation enable the oil to flow and accumulate in larger pools or areas of oil-containing fluid. By injecting the injection fluid simultaneously to the stimulation of the reservoir by mechanical stimulation, the larger pools or areas of oil-containing fluid may be forced towards production wells close to the injection wells.

As shown in FIG. 6, the fluid-activated gun 1 may be arranged in a heel position 24 of the injection or production well. By arranging the gun in the heel portion, the mechanical waves 6 are also transmitted through the casing 25, thus helping the waves propagate further in the formation.

The fluid is pressurised by means of a pump 42 arranged at the well head or blowout preventer as shown in FIG. 6. The pump may also be arranged at the rig 43.

In another embodiment, the gun emits electromagnetic pulse of electromagnetic radiation. The gun may furthermore comprise an electromagnetic hammer.

In the event that the gun is not submergible all the way into the casing, a driving unit, such as a downhole tractor, can be used to push the tools all the way into position in the well. A downhole tractor is any kind of driving tool capable of pushing or pulling tools in a well downhole, such as a Well Tractor®. The downhole tractor comprises wheels arranged on retractable arms.

Although the invention has been described in the above in connection with preferred embodiments of the invention, it will be evident for a person skilled in the art that several modifications are conceivable without departing from the invention as defined by the following claims.

The invention claimed is:

1. A stimulation method comprising the steps of:

arranging a fluid-activated gun in a well through a well head and/or a blowout preventer, dividing the well into a first and a second part, the first part being closer to the well head and/or blowout preventer than the second part;

pressurising the first part of the well with a hot fluid, the hot fluid having a temperature which is higher than that of the formation at a downhole point of injection;

activating the fluid-activated gun, thereby converting energy from the pressurised hot fluid into mechanical waves;

directing said mechanical waves into the formation; and injecting the hot fluid into the formation simultaneous to activation of the fluid-activated gun by means of the hot fluid.

2. A stimulation method according to claim 1, wherein the fluid-activated gun discharges an energy of at least 50 grams TNT equivalence per activation.

3. A stimulation method according to claim 2, wherein the fluid-activated gun is a gas-activated gun or a chemical reaction gun.

4. A stimulation method according to claim 1, further comprising the step of arranging the gun between two neighbouring valves having different inlet flow settings for transmission of mechanical waves into a region of the formation having a high pressure gradient, thereby releasing oil in said region.

5. A stimulation method according to claim 1, further comprising the step of anchoring the fluid-activated gun with at least one anchor in a borehole casing between the first part and the second part of the well before activation.

6. A stimulation method according to claim 1, further comprising the step of inflating a packer surrounding the fluid-activated gun, thereby dividing the well between the first part and the second part before activation of the gun.

7. A stimulation method according to claim 1, wherein the gun emits electromagnetic pulses of electromagnetic radiation.

8. A stimulation method according to claim 1, wherein the fluid-activated gun is activated continuously while the first part of the well is pressurised.

9. A stimulation system for stimulation of oil production in an oil field, comprising:

a production well having a casing;

an injection well having a casing and a well head and/or a blowout preventer; and a fluid-activated gun being arranged in the injection well through the well head and/or the blowout preventer, thereby dividing the injection well in a first and a second part, the first part being closer to the well head and/or blowout preventer than the second part, wherein the first part of the injection well is pressurised with hot fluid to activate the gun, whereby energy from the hot fluid is converted into mechanical waves to be provided into a formation surrounding the casing of the injection well, the hot fluid having a temperature which is higher than that of the formation at a downhole point of injection.

10. A stimulation system according to claim 9, wherein the gun is arranged permanently in the injection well.

11. A stimulation system according to claim 9, wherein the gun comprises a gun body and a packer surrounding the gun body.

12. A stimulation system according to claim 9, wherein the injection well comprises injection openings, and wherein the openings are arranged in the second part of the casing.

13. A stimulation system according to claim 9, wherein the well comprises a heel, and wherein the fluid-activated gun is arranged close to the heel.

14. A stimulation system according to claim 9, further comprising a pump arranged above the well at the well head or the blowout preventer or a rig.

15. A stimulation system according to claim 9, wherein the gun comprises an outlet for letting the fluid enter into the second part of the well after activation of the gun in order for the fluid to be injected into the formation through the opening in the casing wall in the second part of the well.

16. A stimulation system according to claim 9, wherein the fluid-activated gun is a low frequency gun operating at frequencies between 0.01 and 40 Hz.

17. A stimulation system according to claim 9, wherein the fluid-activated gun operates continuously while the first part of the well is pressurised.

18. A stimulation system according to claim 9, wherein the system comprises a plurality of production wells/injection wells, and a plurality of said wells has a fluid-activated gun arranged therein.

19. A stimulation system according to claim 9, further comprising annular barriers at four locations, creating a first production zone between a first annular barrier and a second annular barrier and a second production zone between a third annular barrier and a fourth annular barrier.

20. A stimulation system according to claim 9, wherein the casing comprises a first valve section arranged in the first part of the well and a second valve section arranged in the second part of the well, the valve sections having different flow settings so that a pressure gradient is created in the formation between the first valve section and the second valve section.

* * * * *